US006735283B2

(12) United States Patent
Kutschera et al.

(10) Patent No.: US 6,735,283 B2
(45) Date of Patent: May 11, 2004

(54) ROTATING ANODE X-RAY TUBE WITH MELTABLE TARGET MATERIAL

(75) Inventors: Wolfgang Kutschera, Aurachtal (DE); Eberhard Lenz, Erlangen (DE)

(73) Assignee: Siemens Aktiengesellschaft, Münich (DE)

( * ) Notice: Subject to any disclaimer, the term of this patent is extended or adjusted under 35 U.S.C. 154(b) by 27 days.

(21) Appl. No.: 10/255,977

(22) Filed: Sep. 26, 2002

(65) Prior Publication Data

US 2003/0058995 A1 Mar. 27, 2003

(30) Foreign Application Priority Data

Sep. 26, 2001 (DE) ..... 101 47 473

(51) Int. Cl.[7] ..... H01J 35/10
(52) U.S. Cl. ..... 378/144; 378/125; 378/143
(58) Field of Search ..... 378/119, 121, 378/125, 143, 144

(56) References Cited

U.S. PATENT DOCUMENTS 5,052,034 A 9/1991 Schuster ..... 378/121
6,185,277 B1 2/2001 Harding ..... 378/143
6,477,234 B2 * 11/2002 Harding et al. ..... 378/141
6,560,313 B1 * 5/2003 Harding et al. ..... 378/143
6,647,094 B2 * 11/2003 Harding et al. ..... 378/143

FOREIGN PATENT DOCUMENTS

DE 890 246 7/1949

* cited by examiner

*Primary Examiner*—Edward J. Glick
*Assistant Examiner*—Courtney Thomas
(74) *Attorney, Agent, or Firm*—Schiff Hardin LLP

(57) ABSTRACT

A rotating anode X-ray tube suitable for use in CT installations has a vacuum housing in which a cathode that emits electron beams is rigidly arranged and in which an anode that emits X-rays is rotatably arranged. The anode is arranged at a rotary body that, facing toward the cathode, has a focal path composed of target material that melts during operation of the tube. The rotary body is designed so that the melting target material is held to the anode due to the centrifugal forces of the rotary body when rotating around the cathode.

15 Claims, 3 Drawing Sheets

ROTATING ANODE X-RAY TUBE WITH MELTABLE TARGET MATERIAL

BACKGROUND OF THE INVENTION

1. Field of the Invention

The present invention is directed to a rotating anode X-ray tube suitable for use as a high-power X-ray tube for use in CT (computed tomography) installations.

2. Description of the Prior Art

It is problematical in rotating anode X-ray tubes that the focal path of the target, i.e. the anode surface onto which the electron beams emitted by the cathode are incident, is subject to constant wear during tube operation. This wear leads to a modification of the spectral composition of the X-rays, which usually are emitted in a flat angle. Also, the usable X-ray dose is diminished because of the radiation emitted at the flat angle. Another problem arises due to the stripping of particles from the focal path because increased arcing can occur in the X-ray tube.

In order to reduce the wear of the focal path, it is known to add rhenium to the anode material, usually tungsten. This measure in fact has a beneficial effect on the durability of the anode but does not eliminate the other problems that have been mentioned.

German Patent 890 246 discloses a rigidly arranged anode wherein the focal path of the anode be fashioned as a circulating metallic liquid. Such a fashioning is supposed to have the advantage that the focal spot is constantly replenished and that the X-ray tube can be placed under a substantially greater load. Mercury is cited as liquid in the this reference, this being arranged in an evacuated, closed vessel of, for example, glass. During operation of the tube, the vessel is placed into rotation by means of a rotating electromagnetic field, and the metallic liquid forms a paraboloid of revolution upon rotation under the influence of the rotating field. An opening through which the electrons coming from the cathode can proceed onto the outside surface of the mercury body is situated in the wall of the vessel that accepts the metallic liquid. The X-ray beam generated in this way has the approximate shape of a cone. A collecting device is provided for collecting the mercury that splatters through this opening during rotation, this collecting device also having a space for the condensation of the mercury vapor.

It is obvious that such a fashioning and arrangement of a liquid anode is not only very complicated in design terms but also is already very problematical in and of itself because of the mercury, and is technically not suited for high-power tubes because of the high vapor pressure of the mercury.

Other embodiments of X-ray tubes with a liquid metallic target that have been more recently disclosed (U.S. Pat. Nos. 6,185,277; and 5,052,034) also are affected by the aforementioned disadvantages; and also are not suited for utilization in rotating anode X-ray tubes of the type initially described.

SUMMARY OF THE INVENTION

An object of the present invention is to provide a rotating anode X-ray tube that, in particular, can be used as a high-power tube in a CT installation, with which the aforementioned disadvantages are avoided and with which, in particular, the service life of the anode can be lengthened in an economical way.

The above object is achieved in accordance with the present invention in a rotating anode X-ray tube, particularly of the type suitable for use in CT installations, having a housing with a cathode rigidly arranged therein and an anode rotatably arranged therein, and wherein the anode has a focal path composed of target material that melts during operation of the tube, and wherein, when the target material is in a molten state, it is held to the anode by a rotary body due to centrifugal forces of the rotary body when rotating around the cathode.

The invention is based on the perception of melting the focal path of the anode during operation and thus constantly smoothing it, i.e. keeping it smooth during operation. To avoid the molten material from being thrown off from the anode due to centrifugal forces given rotation of the anode, the rotary body is designed such that the centrifugal forces hold the molten material in place and simultaneously prevent the formation of a parabolic surface.

The inventive anode X-ray tube is comparatively simple to fashion in terms of design and requires no collecting vessel as in the aforementioned known tubes.

In an advantageous embodiment, the anode is arranged at a rotary body that has an annular focal path. The rotary body can be cylindrical or funnel-like, and the anode with the focal path is arranged at the expanded end of the rotary body given the latter design.

Tungsten can be provided as the target material to be melted. Since, however, tungsten already has a vapor pressure above its melting point that could lead to arcing and emission problems given a standard design of a cathode/anode arrangement, a eutectic tungsten alloy having a melting point below that of tungsten and having a vapor pressure of <0.1 hPa in the environment of the melting temperature is advantageously employed.

The following elements are suitable as further materials for the focal path to be melted during operation: tantalum (Ta), osmium (Os), ruthenium (Ru), molybdenum (Mo), niobium (Nb), rhodium (Rh), thorium (Th), palladium (Pd), gold (Au), iridium (Ir), rhenium (Re), platinum (Pt), hafnium (Hf), lanthanum (La). An alloy system of subsets of these elements or boride or carbide compounds of said elements can also be advantageously applied.

In a further version of the invention, the cathode and anode are shielded from one another by partitions and that the cathode thus is protected against vapors from the anode material. The partitions are advantageously provided with a diaphragm in the region of the beam passage that blocks the vapor pressure but is largely transmissive for electrons having kinetic energies that typically lie above approximately 60 keV in this application. Such a version has the advantage that even pure tungsten can be employed as the meltable target material; in particular, materials having higher vapor pressures, and thus materials having higher melting temperatures than, for example, tungsten, can be permitted.

DESCRIPTION OF THE PREFERRED EMBODIMENTS

Figure 1:
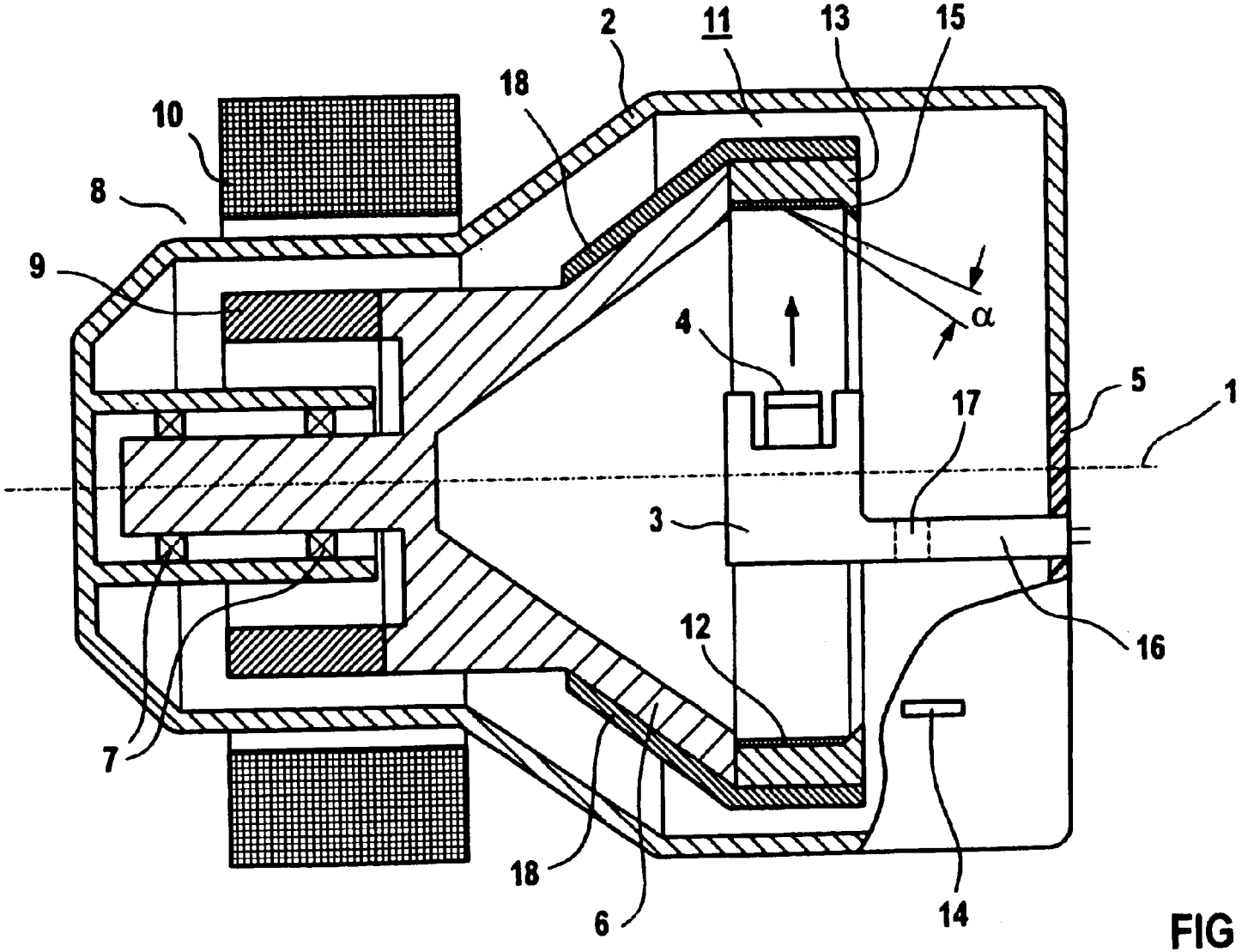
FIG. 1 is a side sectional view of a first embodiment of a rotating anode Xray tube according to the invention.

FIG. 1 shows a simplified illustration of a first embodiment of a rotating anode X-ray tube of the invention. The rotating anode X-ray tube is suitable for use as a high-power X-ray tube for use in CT installations. In such a CT installation, the symmetry axis (referenced 1) of the rotating anode X-ray tube—according to the application—proceeds parallel to the longitudinal axis of the actual CT device of the installation.

The rotating anode X-ray tube contains a vacuum housing 2 in which a cathode 3 is arranged such that its emitter 4—as indicated by an arrow—can radially emit electrons. The vacuum housing 2 can be composed of glass, metal or ceramic. In the case of a metallic embodiment, care must be exercised so that the cathode 3 is electrically separated from the vacuum housing 2 by means of an appropriate insulation 5.

As shown, the emitter 4 can be implemented as a flat emitter; alternatively it can be helical.

A rotary body 6 is rotatably seated in the vacuum housing 2 concentrically with the symmetry axis 1. The bearing of the rotary body is referenced 7 in general and can be formed by rolling bearings that axially and radially support the bearing neck (not referenced in detail) of the rotary body 6. An electrical drive 8 is provided in order to be able to place the rotating anode arrangement into rotation, the drive 8 including a rotor 9 of electrically conductive material (Cu) rigidly connected to the rotary body 6 and a stator 10 arranged outside the vacuum housing 2. In a wellknown way, the stator 10 and the rotor 9 form a squirrel-cage motor that drives the rotary body 6 with a typical frequency of 150 Hz.

Facing away from the drive 8, the rotary body 6 is fashioned funnel-like or conical and carries the anode 11 at its free end. Although the funnel-shaped design of the rotary body 6 is advantageous because it enables a space-saving accommodation of the cathode 3, it is not compulsory in this form. Other embodiments of the rotary body 6 are also conceivable and within the scope of the invention, for example in the form of a cylindrical tube that accepts the anode at one end and the bearing for the drive at its other end.

The anode 11 is annular and surrounds the cathode 3. Facing toward the cathode 3, the anode 11 contains a focal path 12 of meltable target material.

As used herein "meltable target material" means a material that changes from the solid into the liquid solid state due to the heating of the anode 11 (typically to approximately 2800° C.) during operation of the tube and changes vice versa after the tube is turned off.

Facing away from the cathode 3, the anode 11 contains a carrier part 13 composed of a material that does not melt during operation of the tube.

In order to avoid reactions between the target material and the carrier part 13, the latter can be composed of ceramic or graphite, preferably fiber reinforced carbon. Further advantageous materials are standard refractory metals such as molybdenum (Mo), heat-resistant molybdenum alloys, osmium (Os), tungsten (W), rhenium (Re), rhodium (Rh), tantalum (Ta), niobium (Nb), ruthenium (Ru), vanadium (V) and boron (B).

The focal path 12 that melts during operation is composed of an approximately 0.5 through 3 mm thick layer of tungsten or tungsten carbide or of some other suitable material that melts during operation of the tube, for example from the chemical group of carbides or borides or of one of the aforementioned elements. This layer is applied onto the carrier part 13.

To avoid the material that melts during operation of the tube from being thrown off due to centrifugal forces upon rotation of the anode, the carrier part 13 is provided with a suitably fashioned edge 15. Advantageously, the edge 15 is radially directed toward the symmetry axis and may slant slightly inwardly. The target material, which melts during operation of the tube, is thus bonded to the carrier part 13 of the anode and emergence from the target is prevented.

The anode 11 is arranged with reference to the cathode 3 so that the X-rays are emitted at a flat angle $\alpha$ and can emerge through a beam exit window 14 peripherally arranged in the vacuum housing 2.

As can be seen from the illustration of the beam path of the X-rays and from that of the beam exit window 14, the beam path of the X-rays proceeds at about 45° relative to the plane of the drawing.

In an advantageous modification, the X-rays are conducted through the cathode holder 16. To this end, a beam passage window 17 acting a pre-diaphragm is arranged in the holder 16. A reduction of the extra-focal radiation can be achieved with such an arrangement.

So that the X-ray tube can be operated under high load with longer exposure times, in another modification a suitable heat store 18 is provided at least in the region of the anode 11, expediently in the entire region of the cone of the rotary body 6. The heat store 18 is capable of intermediately storing the heat that arises during operation of the tube for a short time. A graphite layer of about 10 through 30 mm that is soldered onto the rotary body 6 has proven advantageous such as a heat store.

Figure 3:
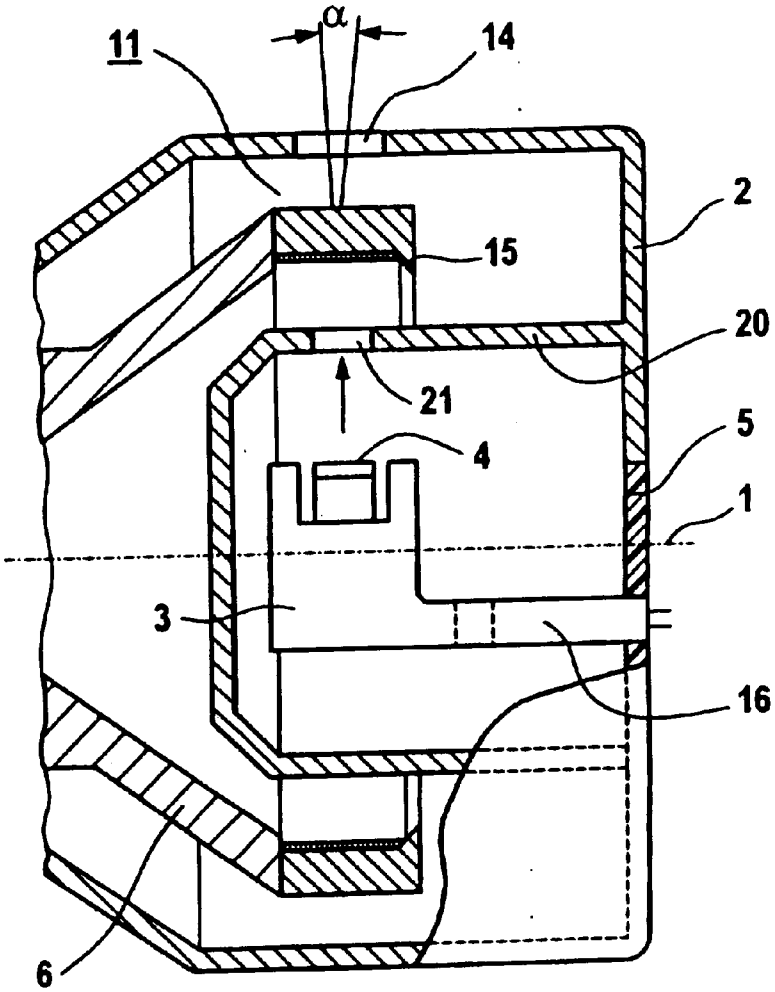
FIG. 3 illustrates a modification of the embodiment according to FIG. 2.
Figure 2:
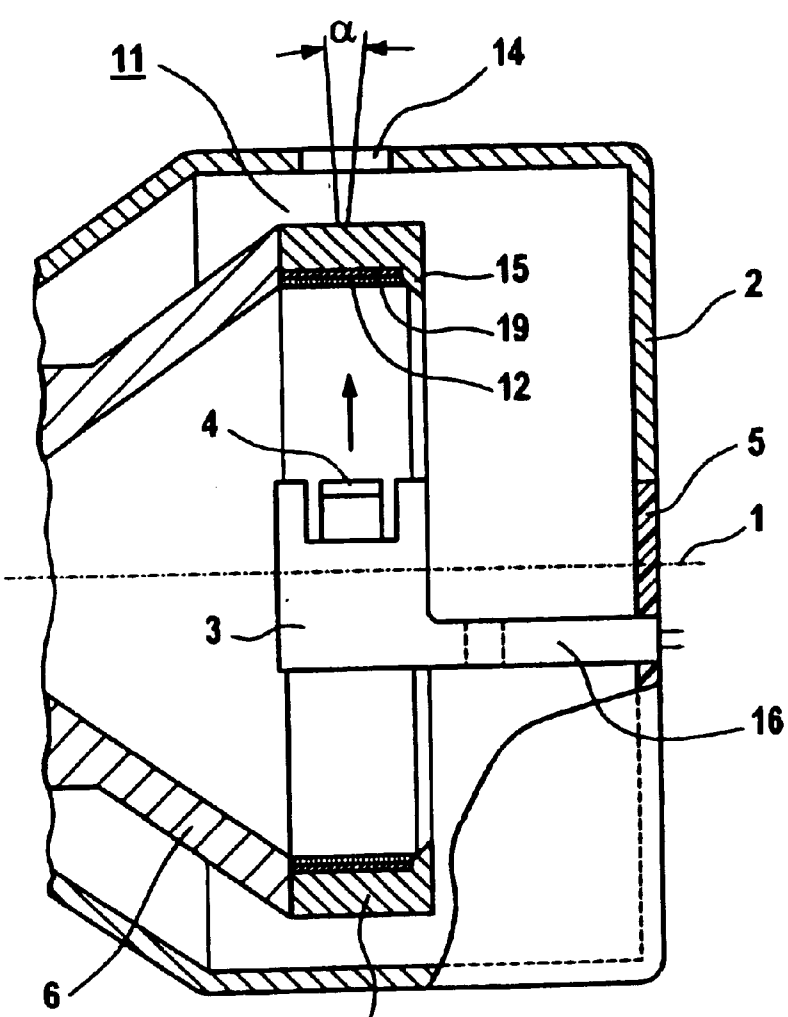
FIG. 2 is a side sectional view of a portion of a second embodiment of a rotating anode X-ray tube of the invention.

In the modifications shown in FIGS. 2 and 3, the anode 11 is fashioned such that the X-rays can pass through the carrier part 13 in the arrow direction. Such an embodiment has a higher efficiency than the version previously explained.

In the embodiment of FIG. 2, the beam exit window 14 also is peripherally arranged at the vacuum housing 2 as an extension of the radial emission of the electrons. In this version, the carrier part 13 is composed of material that is transmissive for X-rays, for example ceramic, graphite or of suitable borides. The target layer applied on the carrier part 13 preferably lies in the range from a few $\mu$m to a maximum of approximately 10 $\mu$m. To suppress a chemical attack on the material of the carrier part 13, a blocking layer 19 of up to 20 $\mu$m thickness of material that does not melt during operation can be applied between the target layer and the carrier part 13.

FIG. 3 shows a further version of a rotating anode X-ray tube wherein partitions 20 are provided between the cathode 3 and the anode 11. These partitions protect the cathode from ion bombardment and the penetration of vapors of anode material. Expediently, the partitions 20 can be part of the vacuum housing and are provided with the diaphragm 21 in the region of the beam passage, said diaphragm 21 being largely transmissive for electrons above, for example, 60 keV but blocking against vapor pressure up to a relatively high vapor pressure of, for example, >1 hPa (dependent on the operating temperature and the selected target material). Since the cathode 3 is protected against vapors of anode material, this version has the advantage that materials having relatively high vapor pressures can be selected as the meltable target material, or that the electron beam power can be increased in the case of tungsten or rhenium (or similar refractory metals).

Figure 4:
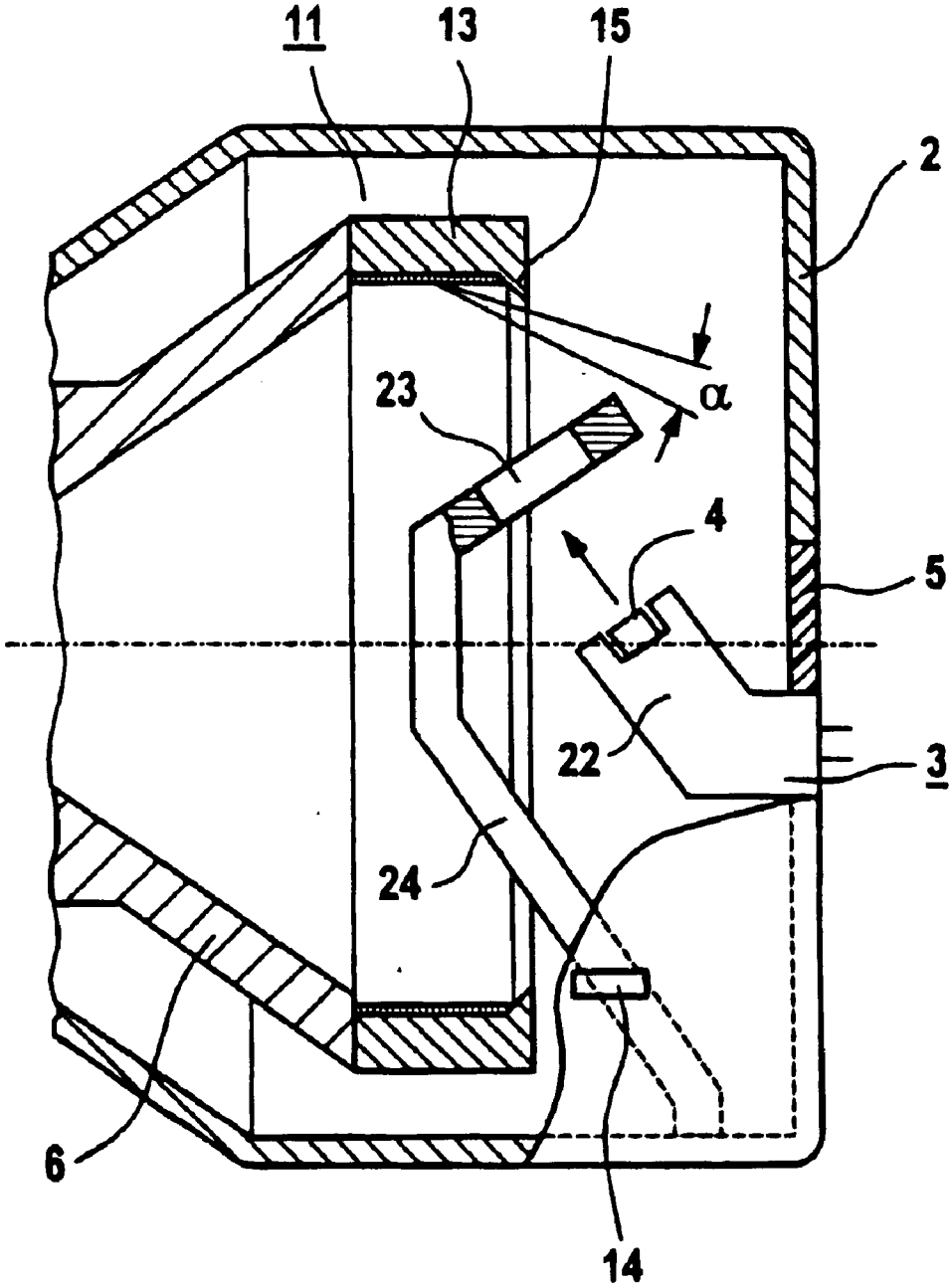
FIG. 4 illustrates a modification of the embodiment according to FIG. 1.

FIG. 4 shows a version wherein the exit of the X-rays—as described for the version according to FIG. 1—ensues laterally at a flat angle a but wherein the cathode does not lie directly within the rotation region of the anode 11. The cathode 3 with the cathode holder 22 is arranged somewhat outside the rotation region. A diaphragm 23 that is carried by a holder 24 secured to the vacuum housing 2 is arranged in the beam path of the electron emission. The diaphragm 23 is of such a nature that it lets electrons through but prevents the passage of ions. The diaphragm holder 24 is electrically conductively connected to the vacuum housing 2 and lies at the same potential as the rotary body 6, preferably at ground. The space between the target and the diaphragm 23 thus is kept free of potential, having the advantage that no arcing can occur given briefly higher vapor pressures in the target region. The emitter of the cathode 3 also is protected against increased ion bombardment.

Although modifications and changes may be suggested by those skilled in the art, it is the intention of the inventors to embody within the patent warranted hereon all changes and modifications as reasonably and properly come within the scope of their contribution to the art.

We claim as our invention:

1. A rotating anode X-ray tube comprising:

an evacuated housing;

a cathode rigidly mounted in said housing;

a rotary body rotatably mounted in said housing;

an anode on said surface of said rotary body, said anode having a focal path composed of target material that melts to a molten state during emission of X-rays; and said rotary body holding said target material in said molten state to said anode by centrifugal forces of said rotary body when rotating around said cathode.

2. A rotating anode X-ray tube as claimed in claim 1 wherein said focal path is annular.

3. A rotating anode X-ray tube as claimed in claim 2 wherein said rotary body is funnel-shaped and has an expanded end, and wherein said surface with said anode thereon is disposed at said expanded end.

4. A rotating anode X-ray tube as claimed in claim 1 wherein said rotary body has an edge at a side of said focal path preventing emergence of said target material in said molten state.

5. A rotating anode X-ray tube as claimed in claim 1 wherein said cathode emits an electron beam which proceeds from said cathode to said anode, said electron beam producing a scatter of ions upon striking said anode, and wherein said rotating anode X-ray tube comprises a diaphragm disposed in a path of said electron beam between said cathode and said anode, said diaphragm comprising material that is transmissive for said electron beam and which blocks said ions.

6. A rotating anode X-ray tube as claimed in claim 5 further comprising a rigid partition shielding said cathode and said anode from each other, said partition having a passage therethrough allowing passage of said electron beam through said partition, said diaphragm being disposed in said passage.

7. A rotating anode X-ray tube as claimed in claim 5 comprising a holder for said diaphragm that is electrically conductively connected to said housing, so that a space between said anode and said diaphragm is free of electrical potential.

8. A rotating anode X-ray tube as claimed in claim 7 wherein said anode and said diaphragm are at ground potential.

9. A rotating anode X-ray tube as claimed in claim 1 wherein said rotary body has a heat-storing layer disposed at a region of said rotary body in thermal communication with said anode.

10. A rotating anode X-ray tube as claimed in claim 1 further comprising a holder for said cathode having a passage therein allowing passage of X-rays from said anode therethrough, said passage serving as a pre-diaphragm.

11. A rotating anode X-ray tube as claimed in claim 1 wherein said rotary body has a carrier part having said surface with said anode thereon, said carrier part containing a barrier layer of material which does not melt during emission of X-rays.

12. A rotating anode X-ray tube as claimed in claim 11 wherein said carrier part is comprised of material selected from the group consisting of ceramic, graphite, fiber reinforced carbon, borides, and carbides.

13. A rotating anode X-ray tube as claimed in claim 11 wherein said carrier part is comprised of at least one refractory metal selected from the group consisting of molybdenum, heat-resistant molybdenum alloys, osmium, tungsten, rhenium, rhodium, tantalum, niobium, ruthenium, vanadium and boron.

14. A rotating anode X-ray tube as claimed in claim 1 wherein said rotary body is comprised of a material selected from the group consisting of graphite, fiber reinforced graphite, ceramic, molybdenum and molybdenum alloys.

15. A rotating anode X-ray tube as claimed in claim 1 wherein said focal path is comprised of at least one material selected from the group consisting of the elements tantalum, osmium, ruthenium, molybdenum, niobium, rhodium; thorium, palladium, gold, iridium, rhenium, platinum, hafnium, lanthanum, alloys of said elements, boride compounds of said elements, and carbide compounds of said elements.

* * * * *